US008322264B1

(12) United States Patent
Van De Wal

(10) Patent No.: US 8,322,264 B1
(45) Date of Patent: Dec. 4, 2012

(54) CONTROLLED PLASTIC VENTING FOR LOW-RECOIL GUN SYSTEMS

(75) Inventor: Brian James Van De Wal, Schodack Landing, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 788 days.

(21) Appl. No.: 12/030,223

(22) Filed: Feb. 13, 2008

Related U.S. Application Data

(60) Provisional application No. 60/889,562, filed on Feb. 13, 2007.

(51) Int. Cl.
*F41A 1/08* (2006.01)
*F42B 5/05* (2006.01)

(52) U.S. Cl. ..... 89/1.703; 89/1.706; 102/437

(58) Field of Classification Search ..... 89/14.05, 89/14.3, 1.703, 1.706; 102/437
See application file for complete search history.

(56) References Cited

U.S. PATENT DOCUMENTS

| | | | | | |
|---|---|---|---|---|---|
| 2,919,629 | A * | 1/1960 | Abramson | ..... | 89/1.703 |
| 2,920,533 | A * | 1/1960 | Musser | ..... | 89/1.706 |
| 2,954,724 | A * | 10/1960 | Musser | ..... | 89/1.706 |
| 3,380,340 | A * | 4/1968 | Bergman et al. | ..... | 89/1.703 |
| 3,613,588 | A * | 10/1971 | Edlund | ..... | 102/469 |
| 4,244,293 | A * | 1/1981 | Grosswendt et al. | ..... | 102/374 |
| 5,216,194 | A * | 6/1993 | Boire | ..... | 89/1.706 |
| 5,900,575 | A * | 5/1999 | Johansson et al. | ..... | 89/1.706 |
| 5,970,307 | A * | 10/1999 | Hong et al. | ..... | 419/54 |
| 6,460,446 | B1 | 10/2002 | Kathe | | |
| 7,353,739 | B2 * | 4/2008 | Ax et al. | ..... | 89/1.701 |

* cited by examiner

*Primary Examiner* — Bret Hayes
(74) *Attorney, Agent, or Firm* — Henry S. Goldfine

(57) ABSTRACT

A pressure release mechanism for a sonic rarefaction wave-type low-recoil gun system employing controlled plastic venting that exhibits adiabatic shear banding to effect a delayed pressure release.

8 Claims, 8 Drawing Sheets

CONTROLLED PLASTIC VENTING FOR LOW-RECOIL GUN SYSTEMS

CROSS REFERENCE TO RELATED APPLICATIONS

This invention claims the benefit of U.S. Provisional Application No. 60/889,562 filed 13-Feb. 2007 the entire file wrapper of which is incorporated by reference as if set forth at length herein.

UNITED STATES GOVERNMENT INTEREST

The inventions described herein may be manufactured, used and licensed by the United States Government for United States Government purposes.

FIELD OF THE INVENTION

This invention relates generally to the field of low recoil gun systems employing a delayed pressure release mechanism. More specifically, it pertains to a delayed pressure release mechanism exhibiting a controlled plastically deforming, adiabatic shear failure mechanism.

BACKGROUND OF THE INVENTION

U.S. Pat. No. 6,460,446—which is incorporated herein by reference as if set forth at length—is directed to a Sonic Rarefaction Wave Recoilless Gun System and issued on 8-Oct.-2002 to Eric L. Kathe and assigned to the assignee of the instant application. That patent describes a low-recoil and low-bore heat gun system that employs a delayed pressure release mechanism for fired propellant charges in the rear of a gun barrel. According to the patent, a delayed pressure release of exhaust gases causes a sonic rarefaction along the length of the gun barrel bore to arrive at an exit end of the gun barrel at a predetermined time, generally coincident with the fired projectile. As a result, such a gun system exhibits lower recoil without an appreciable loss of projectile velocity.

As can be readily appreciated, the delayed pressure release mechanism is a critical component of the Sonic Rarefaction Wave Recoilless Gun System, and essential to its operation. As described in the Sonic Rarefaction Wave Recoilless Gun System patent, the delayed pressure release mechanism comprises a physically heavy, bulky, and mechanically complex inertial breech.

SUMMARY OF THE INVENTION

An advance is made in the art according to the principles of the present invention directed to a pressure release mechanism for a sonic rarefaction wave-type low-recoil gun system employing controlled plastic deformation venting that exhibits adiabatic shear banding phenomena to effect the delayed pressure release.

In sharp contrast to the prior art, a pressure release mechanism according to the present invention uses a controlled plastic deformation based venting exhibiting adiabatic shear banding that advantageously does not employ any inertial breech mechanisms having moving parts, thereby saving space, weight, and complexity.

Instead, in an exemplary embodiment, a pressure release mechanism according to the present invention allows the rear face of a round itself to vent in a controlled and deliberate manner. Advantageously, since the pressure release mechanism is a combination of structural round design and material selection—coupled with a high energy material failure mechanism—each round can be designed for any particular chamber geometry and peak pressure. Since the mechanically complex and heavy inertial breech mechanism is eliminated—a low recoil gun system employing the present invention may advantageously be fired from a shoulder or other lightweight emplacement.

Additionally, a pressure release mechanism according to the present invention—which employs adiabatic shear banding plasticity to effect the venting—is scalable to any caliber gun system and adaptable to any given design criteria including caliber, chamber pressure, chamber profile, and burn profile(s) of a given propellant.

Finally, a pressure release mechanism according to the present invention vents after the system reaches a peak pressure, and therefore allows the use of a variety of materials for its implementation.

BRIEF DESCRIPTION OF THE DRAWING

Further features and advantages of the present invention will be understood with reference to the drawing in which:

FIG. 3 shows a number of views of a sever disk according to the present invention in which: FIG. 3(A) is a top view; FIG. 3(B) is a right side cutaway view; FIG. 3(C) is a left side cutaway view; FIG. 3(D) is a perspective view from the front (top of sever disk); and FIG. 3(E) is a perspective view from the rear (bottom of the sever disk); and FIG. 4 shows the mitigation of rotational momentum of a low recoil gun system according to the present invention in which: FIG. 4(A) is a side view of a gun system and FIG. 4(B) (inset) shows side vents for pressure release which provide rotational mitigation.

DETAILED DESCRIPTION

The following merely illustrates the principles of the invention. It will thus be appreciated that those skilled in the art will be able to devise various arrangements which, although not explicitly described or shown herein, embody the principles of the invention and are included within its spirit and scope.

Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
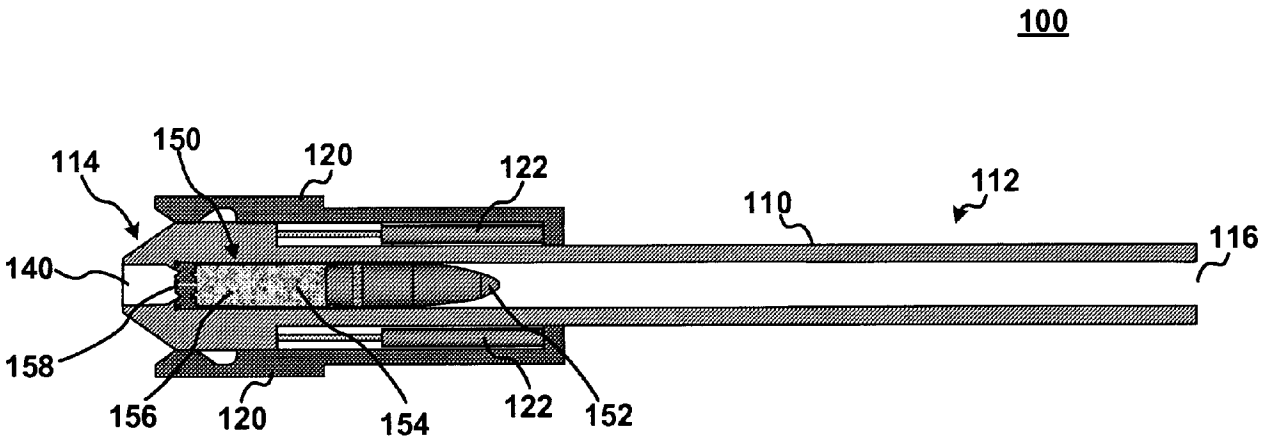
FIG. 1 shows in schematic form a representative cut-away view of a sonic rarefaction wave-type low recoil gun system according to the present invention.

FIG. 1 shows a cutaway view of an exemplary low recoil gun system 100 according to an aspect of the present invention. The gun system 100 includes a barrel 110 positioned within a support cradle 120 which may be part of a turret, carriage, shoulder fired arrangement, or fixed emplacement.

As shown, barrel 110 may be movably positioned within the support cradle 120 and utilize dampers or recoil cylinders 122 to dampen the movement of the barrel 110 relative to the support cradle 120 due to the recoil after a firing.

For the purposes of this discussion, the barrel 110 may be viewed as having a forward end 112 which terminates at an open muzzle 116 and a rear, or breech end 114. Shown within the breech end 114 is an integrated breech vent nozzle 140 through which internal pressure(s) will be vented during operation.

Shown positioned within the barrel 110 is a self venting round 150 generally comprising a cylindrical casing 156 with a projectile 152 inserted into one end of the casing 156 and a sever disk 158 inserted or otherwise positioned at another end of the casing 156 so as to form a closed cylinder (round). Loaded into the casing is a propellant charge 154.

As should be apparent to those skilled in the art, when the round 150 is discharged, the rapidly burning propellant will generate a quantity of expanding gases which in turn propel the projectile 152 along the barrel 110 towards its forward end 112 until it exits the open muzzle 116.

As the propellant 154 burns resulting in the translation of the projectile 152 along the central axis, or bore of the barrel 110, the pressure resulting from the burning propellant 154 builds. In a conventional closed breech gun system the pressure will reach a maximum and is then reduced to atmospheric pressure upon projectile exiting from the muzzle 116.

The maximum rarefaction wave phenomena recoil mitigation results when the breech of the gun system is vented approximately 10% after peak pressure and the resulting rarefaction wave meets the projectile at muzzle exit 116. Consequently, maximum venting time past peak pressure and associated recoil mitigation are realized while not diminishing the kinetic energy of the projectile.

According to the present invention, the sever disk 158 will undergo an adiabatic shear band plastic deformation which will vent the gun system at an appropriate time. Significantly—and according to an aspect of the present invention—the adiabatic shear band produced in the sever disk 158 will survive the peak pressure of the chamber and fail after peak pressure thereby supporting a proper rarefaction delay.

Turning now to FIG. 2(A)-FIG. 2(E), there is shown a series of diagrams which generally depict the operation of the present invention. With simultaneous reference to those figures, it may be seen in FIG. 2(A) that burning propellant produces an expanding gas 158 which—as in a closed breech firing—causes a chamber pressure within the barrel 110 to build behind the projectile 152.

Figure 2A:
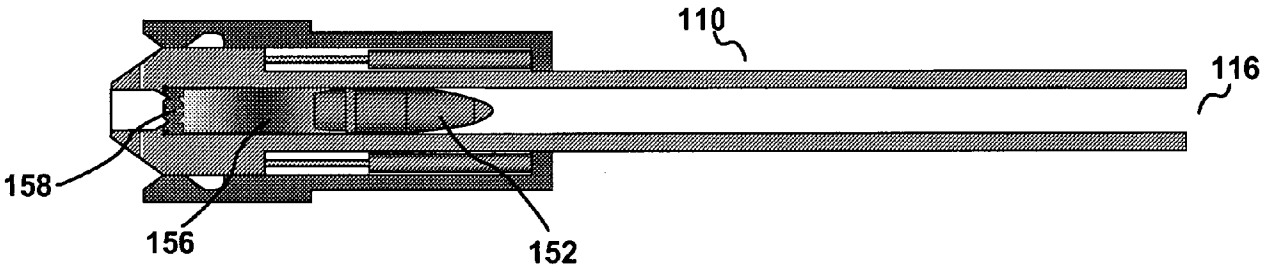
FIG. 2(A) . . .
Figure 2B:
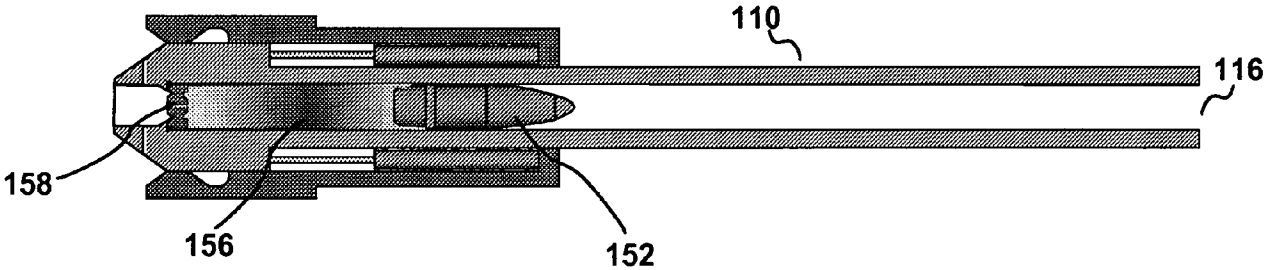
FIG. 2(E) show in schematic form a sequence of events within a Sonic Rarefaction Wave-Type Recoilless Gun System according to the present invention.

Due to the expanding gas 156 the projectile 152 is translated along the bore of the barrel 110 towards the muzzle 116 (FIG. 2(B)). As a result of the internal pressure and heat generated, and strain rate, the sever disk 158 begins to initiate controlled complex plastic deformation due to the generated heat which cannot diffuse. The sever disk begins to undergo controlled dynamic plastic deformation as the pressure increases.

Figure 2C:
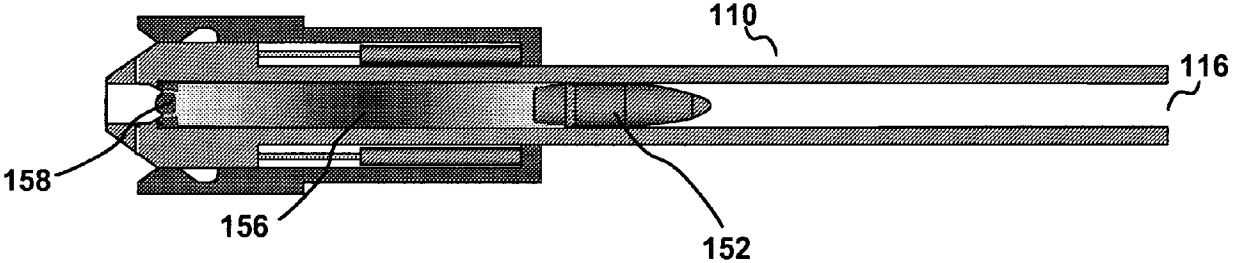

At maximum pressure (FIG. 2(C)), the projectile 152 has translated along the bore of the barrel 110. Although the pressure is still contained, adiabatic shear band is initiated within the sever disk 158.

Figure 2D:
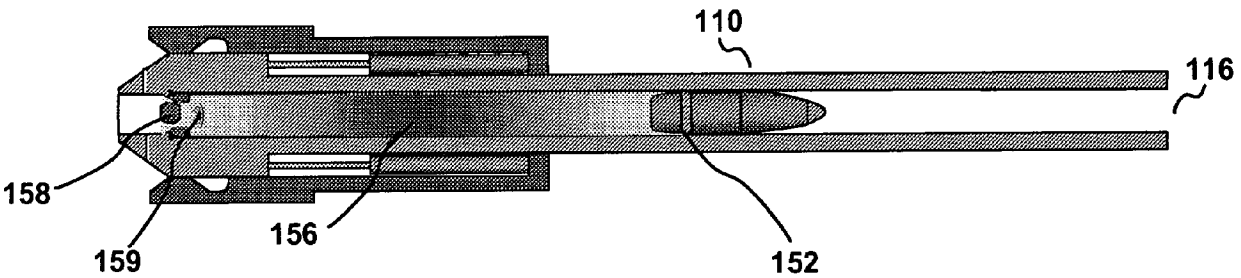

In FIG. 2(D), peak pressure has already occurred and the projectile 152 has translated along a substantial length of the bore of the barrel 110. As the internal pressure continues dropping, the controlled adiabatic shear band propagates within sever disk 158 allowing venting after the peak pressure is reached within barrel. While not specifically shown in great, detail in this FIG. 2(D), a rarefaction wave 159 is created upon venting. The rarefaction wave 159, moving faster than the propellant gases propelling the projectile 152, "chases" the projectile 152 down the bore of the barrel 110.

Figure 2E:
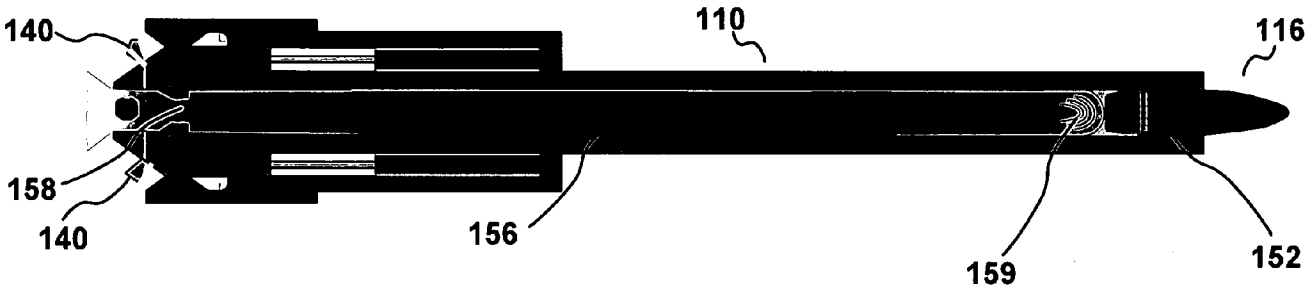

As the projectile reaches the muzzle 116 of the barrel 110, shear band induced catastrophic load bearing capacity collapse of the sever disk 158 permits complete venting of gases 156 which are shown in FIG. 2(E) as venting through integral breech nozzle. As can be now appreciated, the rarefaction wave 159 has met the projectile 152 at muzzle exit 116, which maximizes the rarefaction wave recoil mitigation benefits, and the recoil of the gun system is appreciably reduced.

Figure 3:
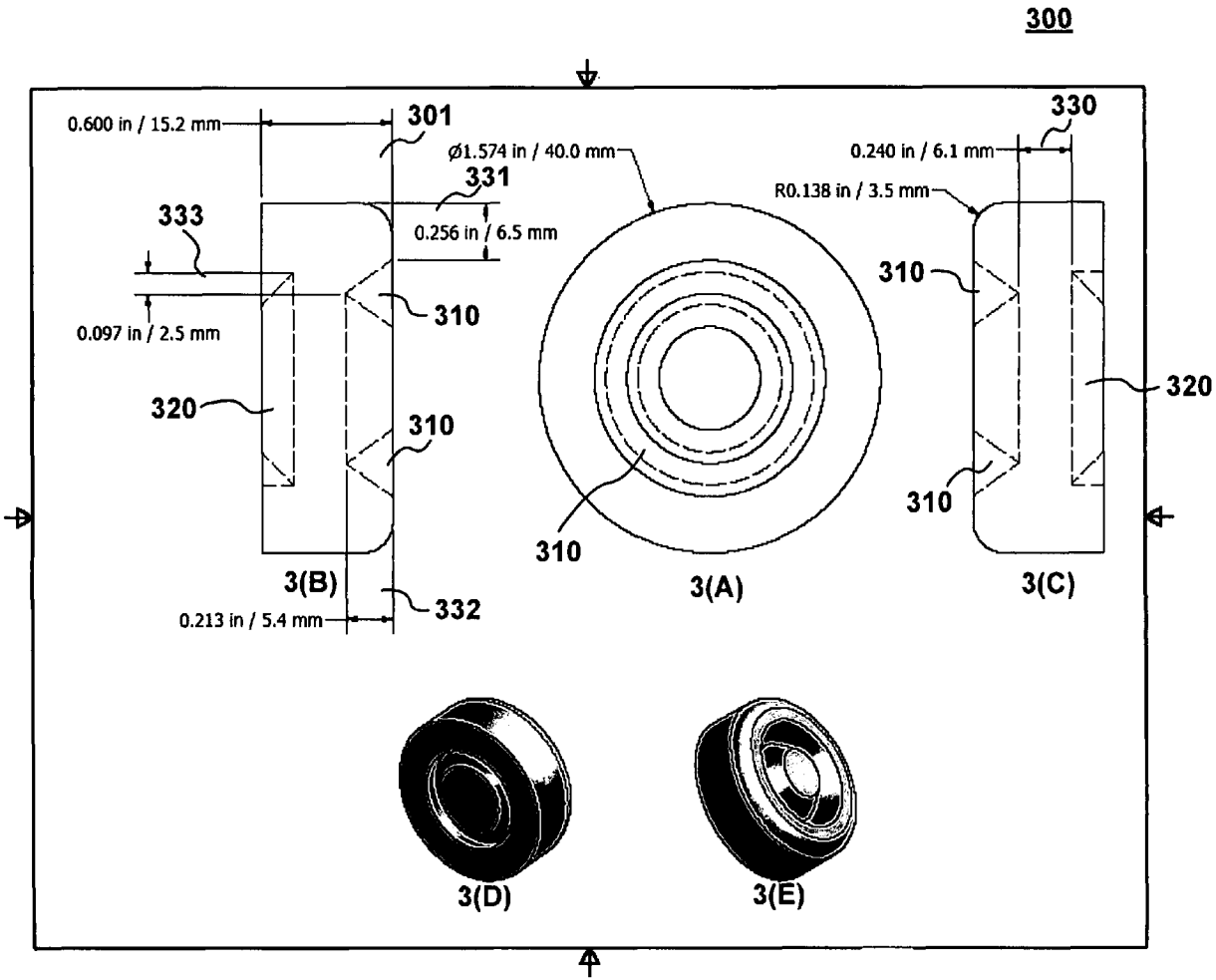

FIG. 3(A)-FIG. 3(E) show a number of views of a representative sever disk 300. FIG. 3(A) shows a top view of the sever disk and its annular, v-shaped groove 310 cut into its bottom surface. FIG. 3(B) and FIG. 3(C) are right and left side cut-away views of the sever disk 300 showing the v-shaped groove 310 and trapezoidal shaped annular "dovetail" 320 cut into its top surface. This "6.5/3.5/2.5" geometry shown in FIG. 3 was determined to be preferable and exhibits a 6.5 mm notch to notch thickness, a 3.5 mm lower (bottom) edge radius, a notch to notch axial offset of 2.5 mm. Note that these dimensions are particular to an AL6061-T651 material for a 30 mm low-recoil gun system (cannon).

More particularly, the particular sever disk in FIG. 3 was purchased according to ASTM B221 standard for aerospace grade 6061-T651 aluminum. The material was Aluminum extruded rod 3" diameter stock. As received, the material exhibited a Yield stress property of 42.5K psi and an ultimate tensile strength property of 48.3 Kpsi. A standard ASTM tensile strength specimen was created to verify these. As those skilled in the art may already be aware, there are minimum strength values for such material certifications, but no specified upper limits. Accordingly, a tensile test and a shear test were undertaken which showed that the material purchased was above the designed value of 35,000 psi for yield stress (and the corresponding shear strength). The materials were annealed to a value of 35,000 psi by a custom annealing process comprising submitting in a HOMO #3 Furnace at 175 C. (374 F.) for approximately 100 hours.

Dimensionally, the exemplary sever disk 300 shown in FIG. 3 may be understood by the following relationships. For a disk substantially 15.2 mm thick 301, if it is given that the notch to notch thickness 330 as parameter A (6.5 mm), then the lower curved radius 332 must be approximately 0.54 A. The bottom notch depth must be approximately 0.83 A (about ⅞'s A). The offset of the top notch to the bottom notch 333 (radial offset) is approximately 0.385 A (about ⅜'s A).

Figure 4:
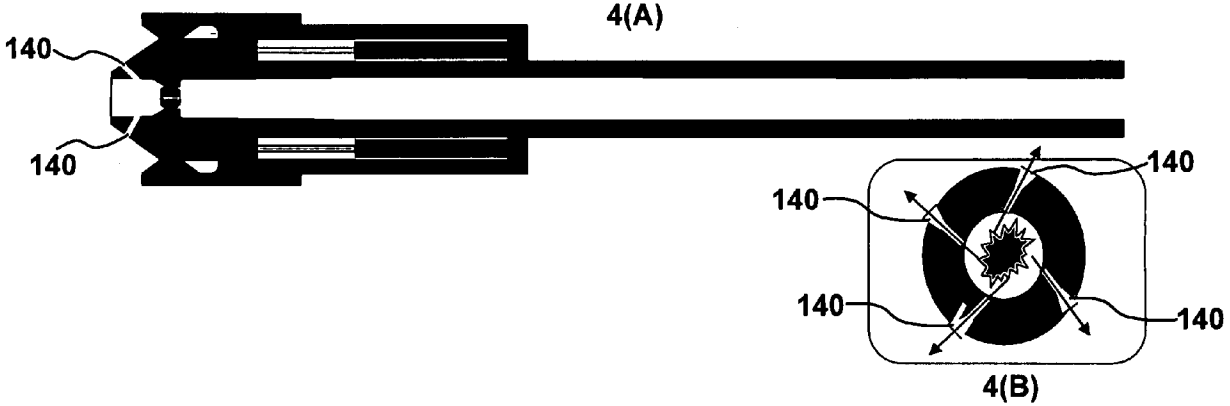

As already noted, such a sever disk 300 will advantageously vent a gun system after peak pressure has been reached in the barrel. That is to say, peak pressure is reached, it begins to fall and then—sometime after peak pressure begins to fall—the sever disk will plastically fail due to adiabatic shear banding thereby venting the pressurized barrel to the atmosphere. When performed in this manner, the recoil is advantageously reduced Of further advantage, the present invention may be used to arrest or otherwise mitigate rotational momentum associated with the firing of a gun system. With reference now to FIG. 4, there is shown a cross section of a gun system 4(A) and a breech end view FIG. 4(B) of that same gun system. As can be appreciated, for a rifled gun system, the spinning projectile imparts a substantial rotational momentum to the gun barrel upon firing. To counteract this rotational momentum, a series of directed "jets" or nozzles 140 are disposed around the perimeter of the breech. Upon firing, the sever disk will vent some of the pressure within the barrel through the nozzles 140. When the nozzles are angled sufficiently, the gases vented through the nozzles will itself impart a rotational momentum to the barrel—which may advantageously be directed to counteract that momentum imparted by the spinning projectile. The number, shape and size of the nozzles 140 may advantageously be varied such that a desirable amount of counteraction is imparted.

At this point, while we have discussed and described the invention using some specific examples, those skilled in the art will recognize that our teachings are not so limited. For example, the preferred embodiments of the invention have been provided for the purpose of explaining the principles of the invention and its practical application, thereby enabling others skilled in the art to understand the invention. Various embodiments and various modifications are contemplated. Accordingly, the invention should be only limited by the scope of the claims attached hereto.

The invention claimed is:

1. A method of mitigating the recoil a gun system comprising the steps of:

firing a projectile in a closed breech gun barrel; and venting the closed breech gun barrel as the projectile translates along a bore of the barrel after a peak pressure in the closed breech gun barrel has been achieved;

wherein the venting is timed so as to produce a sonic rarefaction to travel along a length of the barrel bore;

said method characterized in that the venting of the closed breech gun barrel is produced as a result of a sever disk plastically induced failure through the effect of an adiabatic shear banding in the sever disk.

2. The method of claim 1 further characterized in that:

at least a portion of any gases vented are vented through one or more directional nozzles such that rotational momentum of the barrel is counteracted.

3. The method of claim 1 further characterized in that:

the sever disk has a annular, v-shaped groove along one of its faces and an annular dovetail groove on an opposite face.

4. A low-recoil gun system for firing a projectile using propellant gases evolved by burning propellant comprising:

a barrel having a rear barrel section and a forward barrel section and a bore which extends between the rear barrel section and the forward barrel section which terminates at a muzzle;

the rear barrel section having a delayed pressure release mechanism located behind the projectile;

wherein the delayed pressure release mechanism causes a delayed release of the propellant gases at a time after a peak pressure is experienced within the barrel;

wherein the released propellant gases are expelled in part outside the gun system through a nozzle disposed in the rear portion of the barrel;

wherein the delayed release of the propellant gases is timed to cause a sonic rarefaction wave to travel along a length of the barrel bore toward the muzzle;

characterized in that:

the delayed pressure release mechanism employs a sever disk which undergoes an adiabatic shear event thereby effecting the pressure release.

5. The gun system of claim 4 further characterized in that:

the sever disk has a annular, v-shaped groove along one of its faces and an annular dovetail groove on an opposite face.

6. The gun system of claim 4 further characterized in that:

the rear section of the barrel includes one or more directional nozzles through which at least a portion of any vented gases are discharged upon rupture of the sever disk such that rotational momentum of the barrel is counteracted.

7. A round for firing in a low-recoil gun system, said round comprising:

a cylindrical shell casing;

a projectile disposed within one end of the casing;

a sever disk positioned within an end of the casing opposite the end in which the projectile is disposed; and a quantity of propellant, positioned within the casing between the sever disk and the projectile;

wherein the sever disk is configured to plastically induced failure at a point in time after a peak pressure is realized, such that a quantity of expanding gases are expelled through the ruptured sever disk;

wherein the failure of the sever disk is effected as a result of adiabatic shear band induced phenomena.

8. The round of claim 7 wherein:

the sever disk has a annular, v-shaped groove along one of its faces and an annular dovetail groove on an opposite face.

* * * * *